US011746784B2

(12) United States Patent
Cho

(10) Patent No.: US 11,746,784 B2
(45) Date of Patent: Sep. 5, 2023

(54) FLUID COMPRESSOR

(71) Applicant: Chong Du Cho, Seoul (KR)

(72) Inventor: Chong Du Cho, Seoul (KR)

( * ) Notice: Subject to any disclaimer, the term of this patent is extended or adjusted under 35 U.S.C. 154(b) by 216 days.

(21) Appl. No.: 17/437,867

(22) PCT Filed: Feb. 26, 2020

(86) PCT No.: PCT/KR2020/002760

§ 371 (c)(1),
(2) Date: Sep. 10, 2021

(87) PCT Pub. No.: WO2020/184873

PCT Pub. Date: Sep. 17, 2020

(65) Prior Publication Data

US 2022/0170463 A1 Jun. 2, 2022

(30) Foreign Application Priority Data

Mar. 12, 2019 (KR) ..... 10-2019-0028312

(51) Int. Cl.
*F04C 18/344* (2006.01)
*F04C 23/02* (2006.01)
(Continued)

(52) U.S. Cl.
CPC ..... *F04C 18/344* (2013.01); *F04C 23/02* (2013.01); *F04C 29/005* (2013.01); *F04C 29/04* (2013.01);
(Continued)

(58) Field of Classification Search
CPC .... F04C 2240/70; F04C 23/001; F04C 23/02; F04C 29/005; F04C 18/344
See application file for complete search history.

(56) References Cited

U.S. PATENT DOCUMENTS 2,462,732 A * 2/1949 Dusevoir ..... F04C 2/3442 418/188
4,195,480 A * 4/1980 Shelby ..... F04C 11/00 60/486
(Continued)

FOREIGN PATENT DOCUMENTS

JP 05-118282 A 5/1993
KR 10-2011-0091388 A 8/2011
(Continued)

*Primary Examiner* — Anthony Ayala Delgado
(74) *Attorney, Agent, or Firm* — The Belles Group, P.C.

(57) ABSTRACT

The present invention relates to a fluid compressor comprising: a driving module comprising a driving motor embedded in a motor case; and a compression module comprising a rotor, which is rotatably driven by a driving motor and which has a plurality of variable blades radially provided along the outer peripheral surface thereof, a rotor housing for encompassing the rotor, and a cover of the rotor, for closing the rotor housing, wherein the compression modules are stacked and airtight to block contact between fluid passing through the compression module and air outside the compression module, so that the fluid flowing into any one compression module sequentially passes through the remaining compression modules. The rotary shafts provided in each center of the rotors are connected a shaft coupler. The present invention simultaneously achieves a high-efficiency compression ratio and reduces noise caused by the excessive velocity of any compression module.

10 Claims, 9 Drawing Sheets

(51) Int. Cl.
*F04C 29/00* (2006.01)
*F04C 29/04* (2006.01)

(52) U.S. Cl.
CPC *F04C 2210/1005* (2013.01); *F04C 2210/221* (2013.01); *F05B 2210/12* (2013.01); *F05B 2260/20* (2013.01)

(56) References Cited

U.S. PATENT DOCUMENTS

| | | | | |
|---|---|---|---|---|
| 5,100,308 | A * | 3/1992 | Gevelhoff | F01C 21/104 418/152 |
| 2012/0018168 | A1* | 1/2012 | Denny | F04C 11/001 29/888.023 |

FOREIGN PATENT DOCUMENTS

| | | | |
|---|---|---|---|
| KR | 10-1146341 | B1 | 5/2012 |
| KR | 10-2014-0039598 | A | 4/2014 |
| KR | 10-2015-0017610 | A | 2/2015 |
| KR | 10-2018-0064392 | A | 6/2018 |

* cited by examiner

FLUID COMPRESSOR

CROSS-REFERENCE TO RELATED PATENT APPLICATIONS

The present application is a U.S. national stage application under 35 U.S.C. § 371 of PCT Application No. PCT/KR2020/002760, filed Feb. 26, 2020, which claims priority to Korean Patent Application No. 10-2019-0028312, filed Mar. 12, 2019. The disclosures of the aforementioned priority applications are incorporated herein by reference in their entireties.

TECHNICAL FIELD

The present invention relates to a fluid compressor, and more particularly, to a fluid compressor suitable for various indoor applications, including general homes due to small noises and large compressive performance.

BACKGROUND ART

A mechanism driven by gas pressure and fluid pressure is variously used in homes or in small workplaces or commercial facilities in addition to production sites. For example, a mechanism driven by pneumatic pressure or hydraulic pressure is adopted even in a household drill, a stapler gun, a paint spray, a vacuum cleaner, other automatic doors, an escalator for the disabled, or the like. Therefore, there is an increased demand for a fluid compressor which is driven quietly while operating with a clean compression fluid so as to be more suitable for home applications and may exhibit a large force while being compact and light enough to be portable.

Particularly, a demand for characteristics which have been differentiated from the related arts is increased to achieve higher energy efficiency while being quietly driven due to small noises, and thus, many studies thereof are required.

The compression fluid is not directly used in common due to a temperature increase in a compression process. In this case, it is necessary to be cooled to an appropriate level when a fluid compressed at high pressure is directly used.

In addition to the temperature rise, there is a problem that a condensate is generated in the case of a compressor that compresses gases.

Therefore, if a compressor having no difficulty to be directly used by compression is developed, the usage and the range thereof will be extended to a variety of fields that have not been thought in the related arts.

PRIOR ART DOCUMENT

Korean Patent Publication No. 10-2018-0064392 (published on Jun. 14, 2018)

DISCLOSURE

Technical Problem

Therefore, an object of the present invention is to provide a fluid compressor which can achieve a high compression ratio even while being quiet and lightweight, has better energy efficiency, and can discharge a highly compressed fluid at a sufficiently low temperature.

Technical Solution

An aspect of the present invention provide a fluid compressor comprising: a driving module (10) comprising a driving motor and a motor case in which the driving motor is embedded; and a compression module (20) comprising a rotor (21), which is rotatably driven by means of the driving motor and which has a plurality of variable blades (22) radially provided along the outer peripheral surface thereof, a rotor housing (23) for encompassing the rotor (21), and a cover (25) of the rotor (21), for closing the rotor housing (23), wherein the compression modules (20) are assembled in a form in which two or more compression modules are stacked, the respective compression modules (20) airtightly come in close contact with each other so as to block contact between fluid passing through the compression module (20) and air outside the compression module (20), so that the fluid flowing into any one compression module (20) sequentially passes through the remaining compression modules (20), all the compression modules (20) are driven by means of one driving motor, and rotary shafts (53) provided in each center of the rotors (21) inside the respective compression modules (20) are connected by means of a shaft coupler (51), and thus the present invention simultaneously achieves a high-efficiency compression ratio and reduces noise caused by the excessive velocity of any one compression module (20).

In the rotor (21), a plurality of sliding slots (211) is formed radially toward the outside of the rotor (21) from the center of the rotor 21, and the plurality of variable blades (22) are provided to be inserted to one sliding slot (211) one by one, so that the variable blades (22) are varied according to a centrifugal force due to the rotation of the rotor (21) while being guided along the sliding slots (211) according to the rotation of the rotor (21).

At this time, a horizontal cross-sectional diameter of the rotor (21) is made smaller than a horizontal cross-sectional diameter inside the rotor housing (23), and the center of the rotor (21) is provided in a position which is eccentric inside the rotor housing (23), so that a distance between any one point on an outer circumferential surface of the rotor (21) and an inner circumferential surface of the rotor housing (23) at a shortest distance from the point is varied according to the rotation of the rotor (21).

Meanwhile, an intermediate cooling module (30) formed in a plate shape with a constant thickness is provided between the plurality of compression modules (20), so that the temperature is lowered through the intermediate cooling module (30) before the fluid compressed in any one compression module (20) is introduced to the next compression module (20).

At this time, in the intermediate cooling module (30), preferably, a plurality of venturi nozzle holes (312) are formed, so that the fluid compressed in any one compression module (20) passes through the venturi nozzle holes (312) to be introduced to the next compression module (20).

In this case, a compression fluid accommodation chamber (315) is formed on a lower surface of the intermediate cooling module (30) so that a compressed fluid to be discharged from the compression module (20) disposed below the intermediate cooling module (30) is temporarily accommodated, a compression fluid transmission chamber (313) is formed on an upper surface of the intermediate cooling module (30) so that a compressed fluid to be transmitted to the compression module (20) disposed above the intermediate cooling module (30) is temporarily accommodated, and the compression fluid accommodation chamber (315) and the compression fluid transmission chamber (313) are formed at positions vertically corresponding to each other, wherein the plurality of venturi nozzle holes (312) are formed at the position connecting the compression fluid accommodation chamber (315) and the compression fluid transmission chamber (313), and while the compression fluid is moved from the compression fluid accommodation chamber (315) to the compression fluid transmission chamber (313), a passage cross-sectional area is rapidly reduced, so that the velocity of the compression fluid is increased and the temperature is lowered.

Particularly, a receiving compartment of a cooling fan accommodating compartment (311) in which the cooling fan accommodating compartment (311) is received is formed at the center of the intermediate cooling module (30), the cooling fan accommodating compartment (311) is provided in the receiving compartment of a cooling fan accommodating compartment (311), so that the compression fluid passing through the venturi nozzle holes (312) is additionally cooled by the cooling fan accommodating compartment (311) and the cooling fan accommodating compartment (311) receives the rotational kinetic energy from the driving motor to be driven rotationally.

Further, a planet gear (52) module is provided in at least one of points where the shaft coupler (51) is provided, wherein the planet gear (52) module comprises a ring gear (521) which is fixedly coupled to the rotating shaft (53) below the point to be integrally rotated, a plurality of satellite gears (522) which engage with an inner circumferential surface of the ring gear (521), and one linear gear which is provided at the center of the ring gear (521) and is fixedly coupled to the rotating shaft (53) above the point to be integrally rotated while engaging with the plurality of satellite gears (522) at the same time, so that a rotation angular velocity of the driving motor is accelerated and transmitted to the rotor (21).

Here, when the planet gear (52) modules are provided at two or more points of the points where the shaft coupler (51) is provided, respectively, each planet gear (52) module is formed to have a different acceleration ratio, so that a compression ratio is different from each other between the plurality of compression modules (20).

At this time, preferably, when the compression fluid is gas, a drain through which a condensate generated from the compression fluid is discharged is provided in the intermediate cooling module (30).

Advantageous Effects

According to the present invention, the fluid compressor has effects of achieving a high compression ratio even while being quiet and lightweight, having better energy efficiency, and discharging a highly compressed fluid at a sufficiently low temperature.

EXPLANATION OF REFERENCE NUMERALS AND SYMBOLS

| | |
|---|---|
| 10: Driving motor | 20: Compression module |
| 21: Rotor | 22: Variable blade |
| 23: Rotor housing | 24: Gasket |
| 25: Cover | 30: Intermediate cooling module |
| 32: Cooling fan accommodating compartment | 40: Connecting module |
| 41: Nut | 50: Motion transfer module |
| 51: Shaft coupler | 52: Planet gear |
| 53: Rotation shaft | 60: Main cover |
| 61: Outlet nozzle | 211: Sliding slot |
| 231: First cooling fin | 232: Housing inflow pipe |
| 233: Housing discharge pipe | 241: Gasket communication port |
| 251: Cover communication port | 252: Compression fluid guide |
| 311: Receiving compartment of cooling fan accommodating compartment | |
| 312: Venturi nozzle hole | |
| 313: Compression fluid transmission chamber | |
| 314: Compression fluid transmission groove | |
| 315: Compression fluid accommodation chamber | |
| 316: Compression fluid transmission groove | |
| 317: Second cooling fin | 521: Ring gear |
| 522: Satellite gear | 523: Linear gear |

BEST MODE

Specific structural or functional descriptions presented in embodiments of the present invention are illustrative only for the purposes of describing the embodiments according the concept of the present invention and the embodiments according the concept of the present invention will be implemented in various forms. Further, it should not construed that the present invention is not limited to the embodiments described in the present specification and it should be understood that the present invention covers all the modifications, equivalents and replacements included within the idea and technical scope of the present invention.

Hereinafter, the present invention will be described in detail with reference to the accompanying drawings.

Figure 1:
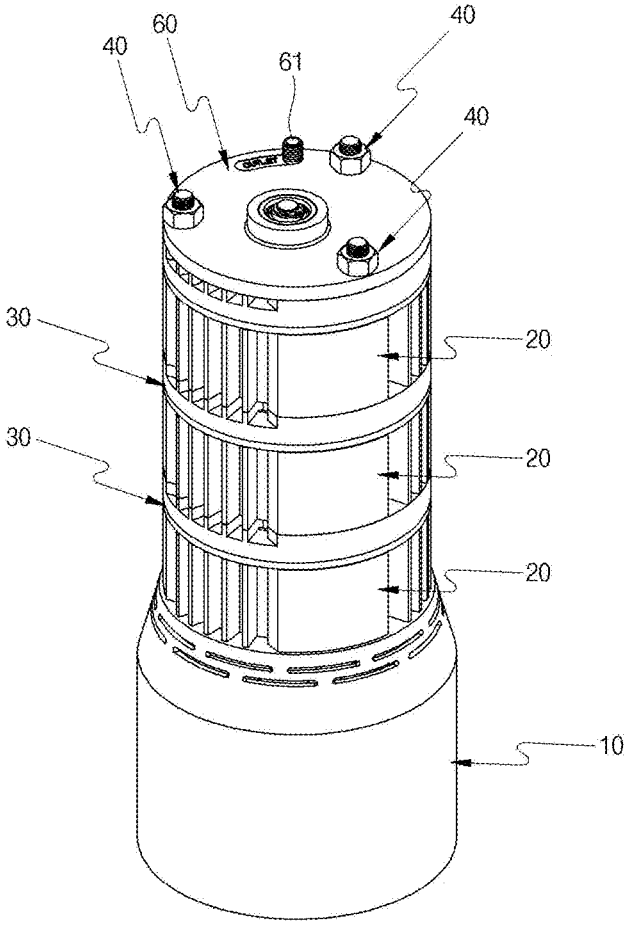
FIG. 1 is a perspective view of a fluid compressor according to the present invention.

A fluid compressor according to the present invention comprises a driving motor (not illustrated) and a compression module 20 as illustrated in FIG. 1.

The driving module 10 comprises the driving motor (not illustrated) and a motor case. In FIG. 1, the driving motor is not directly illustrated, but a part illustrated at the bottom of the fluid compressor according to the present invention is the motor case, and the driving motor is installed in the motor case.

The compression module 20 comprises a rotor 21 which is rotatably driven by the driving motor (not illustrated) and which has a plurality of variable blades 22 radially provided along the outer peripheral surface thereof, a rotor housing 23 for encompassing the rotor 21, and a rotor cover 25 for closing the rotor housing 23. Here, when the rotor 21 is rotated, the variable blades 22 concentrate and compress the fluid in one direction.

Particularly, in the present invention, the compression modules 20 are assembled in a form in which two or more two compression modules are stacked. At this time, the respective compression modules 20 airtightly come in close contact with each other so as to block contact between the fluid passing through the compression module 20 and air outside the compression module 20, so that the fluid flowing into any one compression module 20 sequentially passes through the remaining compression modules 20, all the compression modules 20 are driven by one driving motor (not illustrated), and rotary shafts 53 provided in each center of the rotors 21 inside the respective compression modules 20 are connected by a shaft coupler 51, thereby simultaneously achieving a high-efficiency compression ratio and reducing noise caused by an excessive velocity of any one compression module 20.

That is, when the fluid flowing into the lowermost compression module 20 is compressed stepwise, it is possible to achieve the discharge of the compression fluid that can be actually achieved by a large and fast rotated compressor with a plurality of compressed modules 20 with smaller sizes and low velocity. As a result, since the size of the rotor 21 is smaller and the rotation may be slowed, an effect of quietly operating is obtained.

For reference, even in the related arts, there was a concept itself that many compression modules 20 are connected to each other to reach a fluid compression ratio which is difficult to be achieved by one compressor. However, a form in which many compression modules 20 are combined in one small case to be miniaturized is just now enabled in the present invention. Particularly, while a cooling module to be described below is coupled, a compressor capable of exhibiting a large compression force in home applications or other routine indoor applications may be just achieved by a light compressor enough to be portable, and as a result, a clean compression fluid may also be received.

Figure 4A:
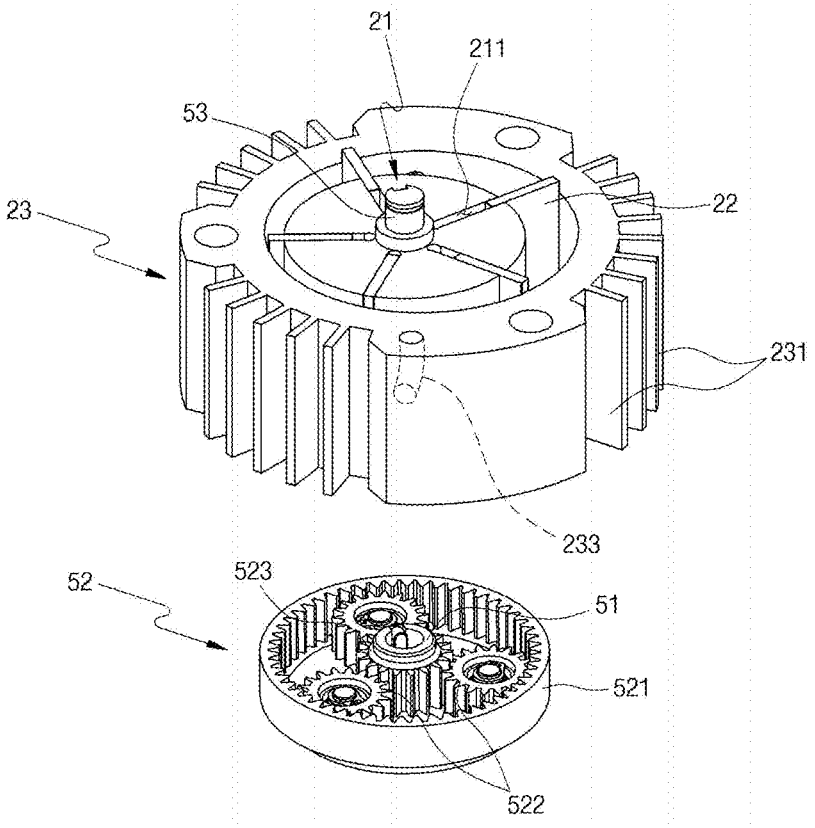
FIG. 4A is a perspective view of the compression module (20) and the motion transfer module in FIG. 2.
Figure 4B:
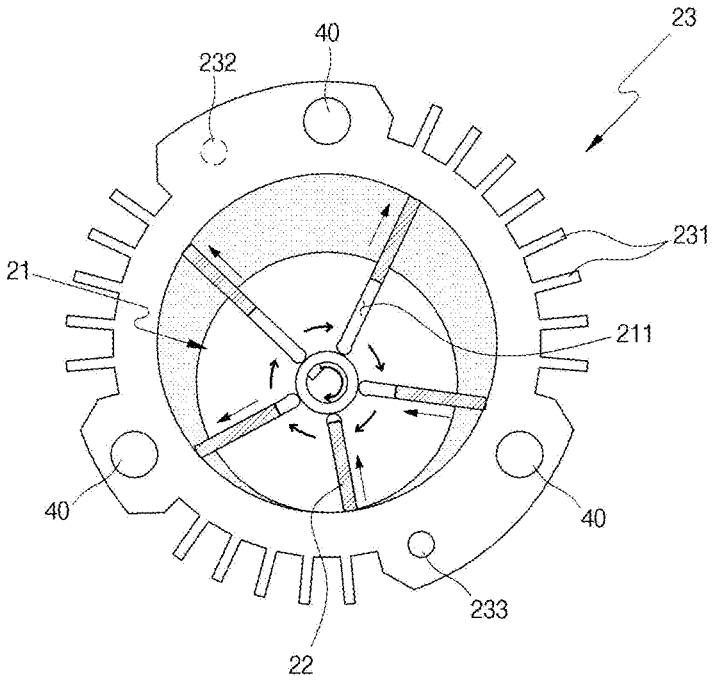
FIG. 4B is a plan view schematically illustrating an operational principle of the compression module (20).

In addition, in the rotor 21, as illustrated in FIG. 4B, a plurality of sliding slots 211 are formed radially toward the outside of the rotor 21 from the center of the rotor 21, and the plurality of variable blades 22 are provided to be inserted to one sliding slot 211 one by one, so that the variable blades 22 are varied according to a centrifugal force due to the rotation of the rotor 21 while being guided along the sliding slots 211 according to the rotation of the rotor 21.

At this time, as illustrated in FIG. 4B, a horizontal cross-sectional diameter of the rotor 21 is made smaller than a horizontal cross-sectional diameter inside the rotor housing 23, and the center of the rotor 21 is provided at a position which is eccentric inside the rotor housing 23, so that a distance between any one point on an outer circumferential surface of the rotor 21 and an inner circumferential surface of the rotor housing 23 at a shortest distance from the point is varied according to the rotation of the rotor 21.

Here, the structure in which the rotor 21 is provided at the position which is eccentric inside the rotor housing 23 is the same as a structure of a conventional vane compressor. At this time, when the rotor 21 is rotated, the variable blades 22 are rotated while an outer end comes in close contact with the inner surface of the rotor housing 23 by the centrifugal force. However, unlike the conventional vane compressor, in the present invention, a spring of connecting the variable blade 22 and the rotor 21 is not separately provided. Accordingly, the variable blade 22 is varied only the centrifugal force and the contact force to the inner surface of the rotor housing 23.

In the present invention, since the compression modules 20 are stacked with each other in multi-stages, a compressive force exhibited by one large-capacity compressor is divided into the compression modules 20 of each stage to compress the fluid, so that the rotor 21 provided in each compression module 20 may be rotated at a low velocity to be quietly operated. However, when the rotor 21 is rotated at the low velocity, in the case of using the conventional rotor 21, there may be a problem that a restoring force by the spring between the variable blade 22 and the rotor 21 is larger than the centrifugal force. Accordingly, in the present invention, the spring between the variable blade 22 and the rotor 21 is not provided. Therefore, as illustrated in FIG. 4B, in the present invention, the variable blade 22 is withdrawn by a sliding operation in the sliding slot 211 by the centrifugal force, and gradually inserted into the sliding slot 211 again when the contact force to the inner surface of the rotor housing 23 is stronger.

Figure 2:
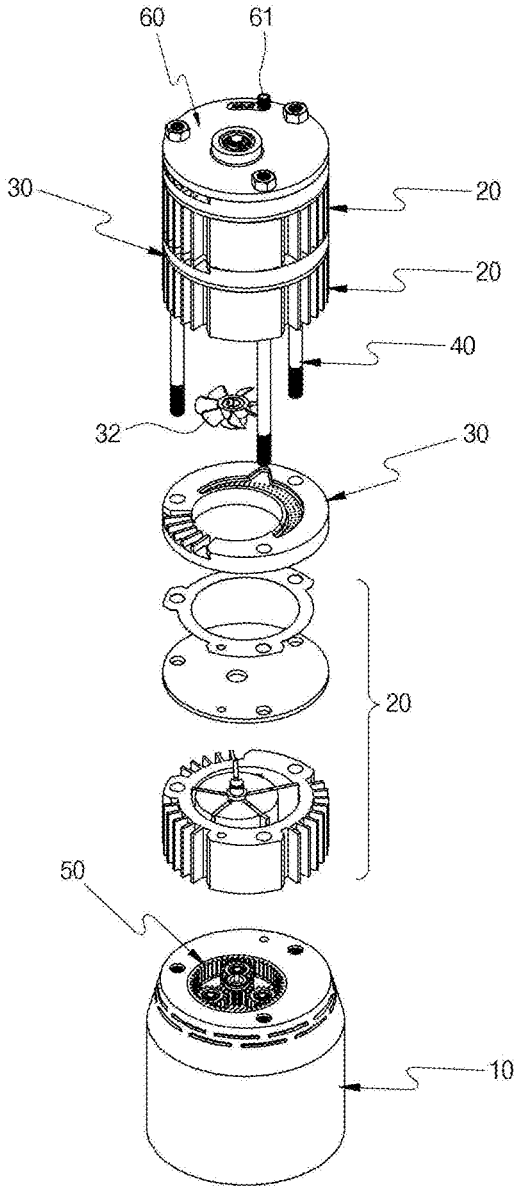
FIG. 2 is an exploded perspective view of FIG. 1.
Figure 3:
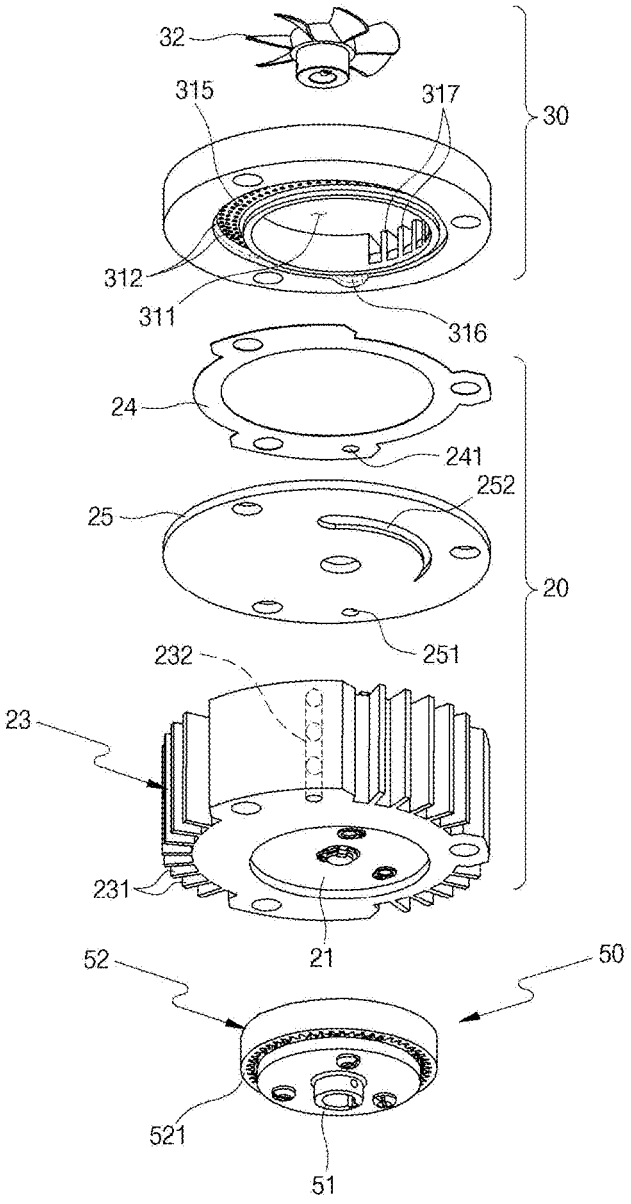
FIG. 3 is a bottom exploded perspective view of a compression module (20), a cooling module and a motion transfer module in FIG. 1.

Meanwhile, in the present invention, as illustrated in FIGS. 2 and 3, an intermediate cooling module 30 formed in a plate shape is provided between the plurality of compression modules 20, so that the temperature is lowered before the fluid compressed in any one compression module 20 is introduced to the next compression module 20.

Figure 6:
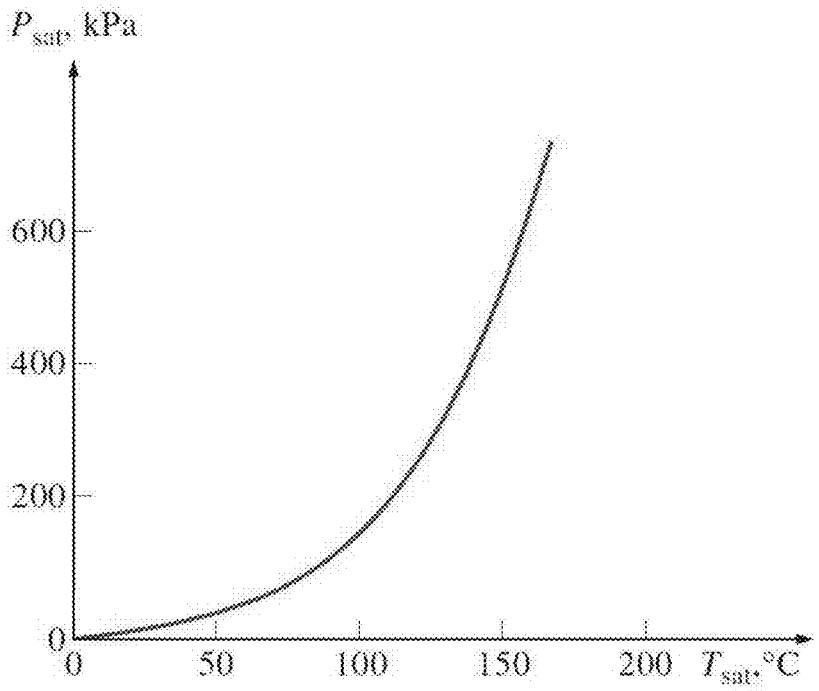
FIG. 6 is a saturated vapor curve of water.

As described in the background art above, as the fluid is compressed, the temperature rises. For example, as a saturated vapor curve of water illustrated in FIG. 6, as the pressure of the fluid is increased, the temperature is also increased.

Accordingly, when only the compression is performed without the cooling process, since the compression fluid to be finally discharged reaches a significantly high temperature, there is a problem that it is difficult to directly use the compression fluid and additional insulation is required to prevent hot heat from being emitted to the inside.

For the problem, in the present invention, as illustrated in FIGS. 2 and 3, the intermediate cooling module 30 formed in the plate shape is provided between the plurality of compression modules 20. Particularly, in the intermediate cooling module 30, a plurality of venturi nozzle holes 312 are formed, so that the fluid compressed in any one compression module 20 passes through the venturi nozzle holes 312 to be introduced to the next compression module 20.

Further, as illustrated in FIGS. 2 and 3, a compression fluid accommodation chamber 315 is formed on a lower surface of the intermediate cooling module 30 so that a compressed fluid to be discharged from the compression module 20 disposed below the intermediate cooling module 30 is temporarily accommodated. A compression fluid transmission chamber 313 is formed on an upper surface of the intermediate cooling module 30 so that a compressed fluid to be transmitted to the compression module 20 disposed above the intermediate cooling module 30 is temporarily accommodated. The compression fluid accommodation chamber 315 and the compression fluid transmission chamber 313 are formed at positions vertically corresponding to each other.

Particularly, here, the plurality of venturi nozzle holes 312 are formed at a position connecting the compression fluid accommodation chamber 315 and the compression fluid transmission chamber 313. Accordingly, while the compression fluid passes through the venturi nozzle holes 312 which are suddenly narrowed from a wide space of the compression fluid accommodation chamber 315, a passage cross-sectional area is rapidly decreased and a passing rate is rapidly increased, so that the pressure is lowered to a constant degree by a venturi effect.

That is, the fluid passing through the venturi nozzle holes 312 has a constant pressure loss, but is simultaneously cooled to prevent various problems caused by compressing the hot compression fluid again.

Further, a cooling fan accommodating compartment 311 is subsidiarily provided in a receiving compartment of the cooling fan accommodating compartment 311 as illustrated in FIG. 2 in addition to the venturi nozzle holes 312.

The plate forming the intermediate cooling module 30 has a constant thickness, but needs to be provided between the plurality of compression modules 20 in one case, so that a space occupied by the intermediate cooling module 30 needs to be minimized. As such, while the intermediate cooling module 30 is provided at the same height to derive the maximum cooling efficiency while occupying only the minimum space, an additional cooling means is provided at a different position on a horizontal plane to maximize both the space efficiency and the cooling efficiency. Accordingly, as illustrated in FIGS. 2 and 3, the cooling fan is provided at the same height as the position where the venturi nozzle holes 312 are formed, but is provided in the cooling fan accommodating compartment 311 which is a compartment isolated from the venturi nozzle holes 312.

The cooling fan accommodating compartment 311 is airtightly isolated from the compression fluid accommodation chamber 315 or the compression fluid transmission chamber 313 to prevent exchange between the fluids from being generated. To this end, a cover 25 and a gasket 24 are provided on the rotor 21 and the rotor housing 23 as illustrated in FIG. 2.

Meanwhile, in the present invention, a rotation shaft 53 rotating the rotor 21 provided in the compression module 20 at each stage may also be provided while only one rotation shaft 53 connected to each other is connected to the driving motor (not illustrated). Further, the rotation shaft 53 rotating the rotor 31 at each stage is separately provided, but may be connected to be linked to a shaft coupler 51 illustrated in FIG. 3.

In addition, a compression ratio of the compression module 20 at each stage may need to be different from each other. This is because the fluid compressor according to the present invention may have various requirements depending on the applications to be used. For example, the compressor to be used indoor has a degree of compression performance and may require extreme quietness. As such, when the quietness is important, the compressed module 20 of each stage is rotated at a completely low velocity for each rotor 21, but particularly, rotated at a lower velocity toward the upper portion, so that the noise may be almost minimized.

Also, in order to generate a maximum high-pressure fluid with the same size of compressors, it may be necessary to increase the rotation speed of the rotor 21 of each stage stepwise.

As such, when there is a difference in rotation angular velocity of the rotor 21 of each stage, based on a coupler connecting the rotation shaft 53 with the rotor 21 at each stage, the lower rotation shaft 53 and the upper rotation shaft 53 need to be separated from each other, and to have a structure in which the rotor 21 may be rotated at a different velocity.

To this end, in the present invention, a planet gear 52 may be provided between the respective stages. The planet gear 52 is generally formed in a flat plate shape unlike a gear box of increasing the rotational speed and simultaneously, all gears are provided at the same height to minimize the space occupation, so that the fluid compressor according to the present invention may be manufactured in a compact size.

The planet gear 52 consists of a ring gear 521 which has the largest diameter and teeth formed on an inner circumferential surface thereof, a linear gear 523 disposed at the center of the ring gear 521, and a satellite gear 522 which comes into contact with both an outer circumferential surface of the linear gear 523 and an inner circumferential surface of the ring gear 521. At this time, the rotational speed may be amplified according to a gear ratio among the linear gear 523, the satellite gear 522, and the ring gear 521. Since the technique of the planet gear 52 is the related art, the detailed description thereof will be omitted.

In the present invention, the rotation shaft 53 connected to the ring gear 521 and the rotation shaft 53 connected to the linear gear 523 are different from each other. The rotation shaft 53 of the compression module 20 provided on the lower part is connected to the ring gear 521, and the rotation shaft 53 of the compression module 20 provided on the upper part is connected to the linear gear 523. At this time, a coupler may be provided between the rotation shaft 53 and the gear to be connected.

On the other hand, when the compression fluid is gas, a condensate may be generated due to cooling while the compression fluid passes through the intermediate cooling module 30. Accordingly, in the intermediate cooling module 30, a separate condensate drain (not illustrated) may be provided for discharging the condensate. Although the condensate drain is not illustrated, the condensate may be formed in the innermost side of the compression fluid accommodation chamber to be discharged by a centrifugal force using a larger mass than the compression gas. In this case, the condensate may be discharged to the drain without being removed through the venturi nozzle holes 312 due to acceleration and centrifugal force.

Figure 5A:
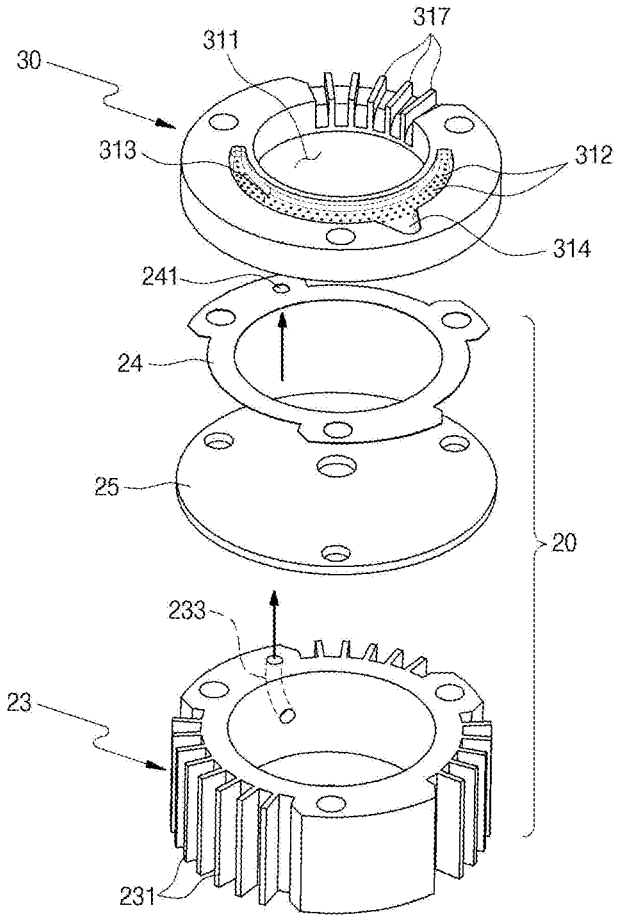
FIGS. 5A to 5C are exploded perspective views illustrating a transmission process of a compression fluid.
Figure 5B:
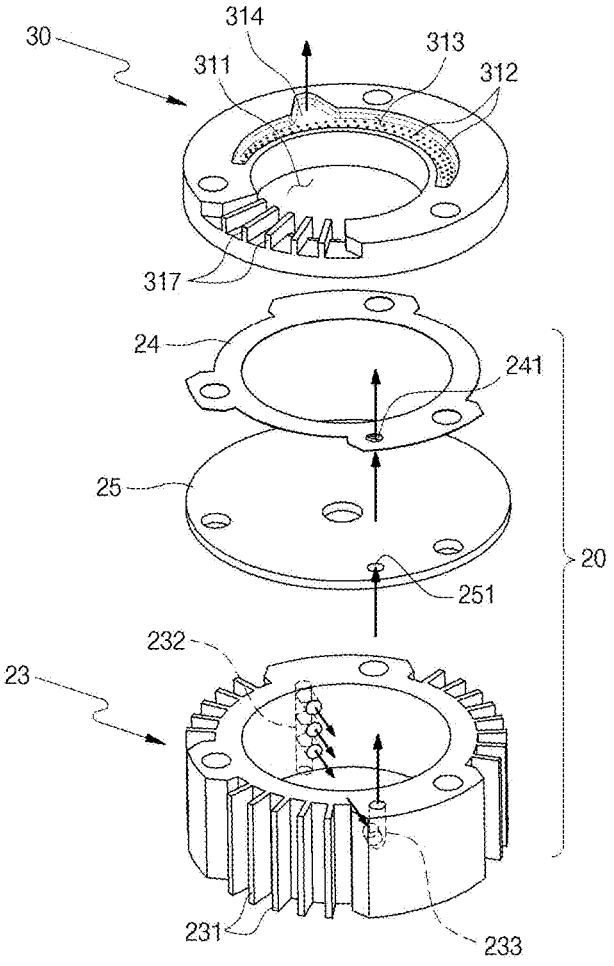
Figure 5C:
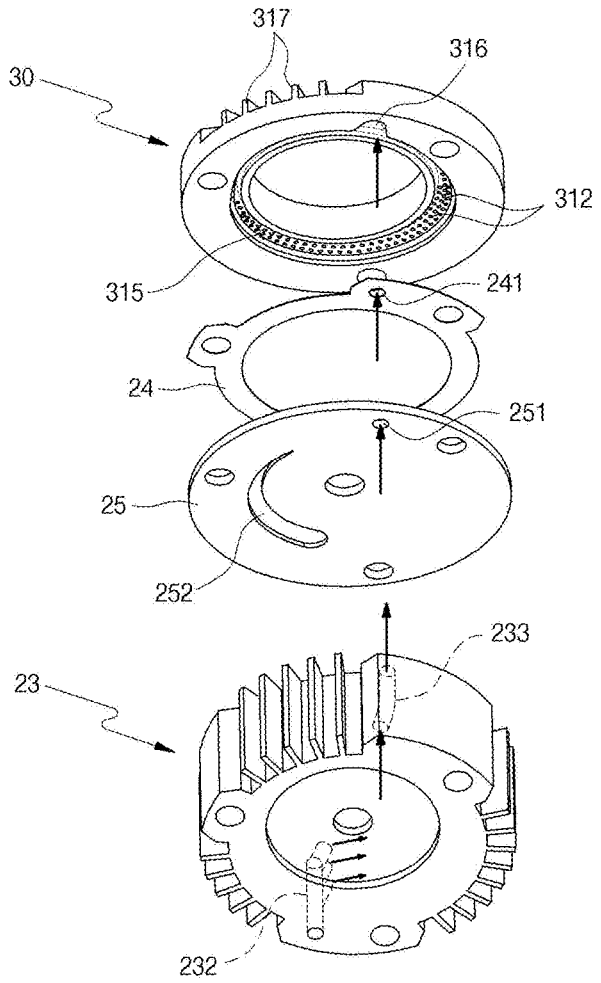

In addition, in the present invention, a pathway flowing with the compression fluid is illustrated in FIGS. 5A to 5C.

Referring to FIGS. 5A to 5C, the compression fluid first flows into the rotor housing 23 through a housing inflow pipe illustrated in FIG. 5B. The compression fluid flowing into the rotor housing 23 is concentrated to a housing discharge pipe illustrated in FIG. 5B due to the variable blade 22 as illustrated in FIG. 4B to be discharged through the housing discharge pipe illustrated in FIG. 5B. The compression fluid discharged through the housing discharge pipe is accommodated in the compression fluid accommodation chamber 315 as illustrated in FIG. 5C through a cover communication port formed in the cover 25 and a gasket communication port formed in the gasket.

At this time, the fluid discharging through the gasket communication port flows into the compression fluid accommodation chamber 315 through a compression fluid transmission groove formed in the compression fluid accommodation chamber 315. The compression fluid flowing into the compression fluid accommodation chamber 315 is introduced to the compression fluid transmission chamber 313 through the venturi nozzle holes 312 as illustrated in FIG. 5B. The compression fluid flowing into the compression fluid transmission chamber 313 flows into an upper rotor housing 23 through a housing inflow pipe (not illustrated) formed in the rotor housing 23 provided at the upper part through the compression fluid transmission groove again.

Here, referring to FIG. 5C, for reference, a drain pipe (not illustrated) may be formed at an opposite end portion of the compression fluid transmission groove even in the compression fluid accommodation chamber 315. This is because the condensate may be moved to the end portion of the compression fluid transmission groove without being discharged through the venturi pipe due to larger acceleration than the compression fluid made of gas. However, a detailed installation position of the drain pipe is not limited to this description.

In addition, a second cooling fin 317 may be formed at a portion spaced apart from the compression fluid accommodation chamber 315 and the compression fluid transmission chamber 131 in the intermediate cooling module 30. Since the second cooling fin 317 is formed, the amount of heat discharged from the compression fluid to be cooled may be discharged through the second cooling fin 317 without flowing toward the compression fluid accommodation chamber 315 and the compression fluid transmission chamber 131.

The present invention described above is not limited to the aforementioned embodiments and the accompanying drawings, and it will be apparent to those skilled in the art to which the present invention pertains that various substitutions, modifications, and changes can be made without departing from the technical spirit of the present invention.

The invention claimed is:

1. A fluid compressor comprising:

a driving module comprising a driving motor and a motor case in which the driving motor is embedded; and a compression module comprising a rotor, which is rotatably driven by means of the driving motor and which has a plurality of variable blades radially provided along the outer peripheral surface thereof, a rotor housing for encompassing the rotor, and a cover of the rotor, for closing the rotor housing, wherein the compression modules are assembled in a form in which two or more compression modules are stacked, the respective compression modules airtightly come in close contact with each other so as to block contact between a fluid passing through the compression module and air outside the compression module, so that the fluid flowing into any one compression module sequentially passes through the remaining compression modules, all the compression modules are driven by means of one driving motor, and rotary shafts provided in each center of the rotors inside the respective compression modules are connected by means of a shaft coupler, thereby simultaneously achieving a high-efficiency compression ratio and reduces noise caused by the excessive velocity of any one compression module.

2. The fluid compressor of claim 1, wherein in the rotor, a plurality of sliding slots are formed radially toward the outside of the rotor from the center of the rotor, and the plurality of variable blades are provided to be inserted to one sliding slot one by one, so that the variable blades are varied according to a centrifugal force due to the rotation of the rotor while being guided along the sliding slots according to the rotation of the rotor.

3. The fluid compressor of claim 2, wherein a horizontal cross-sectional diameter of the rotor is made smaller than a horizontal cross-sectional diameter inside the rotor housing, and the center of the rotor is provided in a position which is eccentric inside the rotor housing, so that a distance between any one point on an outer circumferential surface of the rotor and an inner circumferential surface of the rotor housing at a shortest distance from the point is varied according to the rotation of the rotor.

4. The fluid compressor of claim 1, wherein an intermediate cooling module formed in a plate shape with a constant thickness is provided between the plurality of compression modules, so that the temperature is lowered through the intermediate cooling module before the fluid compressed in any one compression module is introduced to the next compression module.

5. The fluid compressor of claim 4, wherein in the intermediate cooling module, a plurality of venturi nozzle holes are formed, so that the fluid compressed in any one compression module passes through the venturi nozzle holes to be introduced to the next compression module.

6. The fluid compressor of claim 5, wherein a compression fluid accommodation chamber is formed on a lower surface of the intermediate cooling module so that a compressed fluid to be discharged from the compression module disposed below the intermediate cooling module is temporarily accommodated, a compression fluid transmission chamber is formed on an upper surface of the intermediate cooling module so that a compressed fluid to be transmitted to the compression module disposed above the intermediate cooling module is temporarily accommodated, and the compression fluid accommodation chamber and the compression fluid transmission chamber are formed at positions vertically corresponding to each other, wherein the plurality of venturi nozzle holes are formed at the position connecting the compression fluid accommodation chamber and the compression fluid transmission chamber, and while the compression fluid is moved from the compression fluid accommodation chamber to the compression fluid transmission chamber, a passage cross-sectional area is rapidly reduced, so that the velocity of the compression fluid is increased and the temperature is lowered.

7. The fluid compressor of claim 6, wherein a receiving compartment of a cooling fan accommodating compartment in which the cooling fan accommodating compartment is received is formed at the center of the intermediate cooling module, the cooling fan accommodating compartment is provided in the receiving compartment of the cooling fan accommodating compartment, so that the compression fluid passing through the venturi nozzle holes is additionally cooled by the cooling fan accommodating compartment and the cooling fan accommodating compartment receives the rotational kinetic energy from the driving motor to be driven rotationally.

8. The fluid compressor of claim 1, wherein a planet gear module is provided in at least one of points where the shaft coupler is provided, wherein the planet gear module comprises a ring gear which is fixedly coupled to the rotation shaft below the point to be integrally rotated, a plurality of satellite gears which engage with an inner circumferential surface of the ring gear, and one linear gear which is provided at the center of the ring gear and is fixedly coupled to the rotation shaft above the point to be integrally rotated while engaging with the plurality of satellite gears at the same time, so that a rotation angular velocity of the driving motor is accelerated and transmitted to the rotor.

9. The fluid compressor of claim 2, wherein when the planet gear modules are provided at two or more points of the points where the shaft coupler is provided, respectively, each planet gear module is formed to have a different acceleration ratio, so that a compression ratio is different from each other between the plurality of compression modules.

10. The fluid compressor of claim 9, wherein when the compression fluid is gas, a drain through which a condensate generated from the compression fluid is discharged is provided in the intermediate cooling module.

* * * * *